US007411558B1

(12) United States Patent
Gerhard

(10) Patent No.: US 7,411,558 B1
(45) Date of Patent: Aug. 12, 2008

(54) BUOYANT CABLE ANTENNA CONFIGURATION AND SYSTEM

(75) Inventor: Erich M. Gerhard, deceased, late of South Kingstown RI (US); by Heidi R. Pickreign, legal representative, Harvard, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 21 days.

(21) Appl. No.: 11/650,762

(22) Filed: Dec. 26, 2006

(51) Int. Cl.
*H01Q 1/34* (2006.01)

(52) U.S. Cl. ..... 343/709; 343/719

(58) Field of Classification Search ..... 343/709, 343/719, 877
See application file for complete search history.

(56) References Cited

U.S. PATENT DOCUMENTS 3,599,213 A * 8/1971 Fessenden et al. ..... 343/710
3,961,589 A * 6/1976 Lombardi ..... 114/328
H1220 H 8/1993 Pease
5,272,486 A * 12/1993 Dickinson ..... 343/719
5,517,202 A * 5/1996 Patel et al. ..... 343/709
5,933,117 A * 8/1999 Gerhard ..... 343/709
6,870,508 B1 * 3/2005 Rivera ..... 343/709

* cited by examiner

*Primary Examiner*—Hoang V Nguyen
(74) *Attorney, Agent, or Firm*—James M. Kasischke; Jean-Paul A. Nasser; Michael P. Stanley

(57) ABSTRACT

A buoyant cable system and method is provided with a towed transmission line and antenna platform that may be deployed into the water from a submerged submarine so that the antenna extends above the surface of the water. The cable system preferably utilizes a flexible weighted keel formed in a section of the transmission line. A buoyant section of transmission line extends upwardly from the depth of the weighted keel to support one or more antennas above the surface of the water. In another embodiment, a plurality of weighted keels may be formed in sections of the transmission line whereby an inverted U-shaped buoyant portion extends upwardly from the depth of weighted keel to act as the support for a horizontally oriented antenna.

13 Claims, 2 Drawing Sheets

BUOYANT CABLE ANTENNA CONFIGURATION AND SYSTEM

STATEMENT OF GOVERNMENT INTEREST

The invention described herein may be manufactured and used by or for the Government of the United States of America for governmental purposes without the payment of any royalties thereon or therefore.

CROSS-REFERENCE TO RELATED APPLICATIONS

The instant application is related to three co-pending U.S. patent application Ser. Nos. entitled BUOYANT CABLE ANTENNA SYSTEM AND METHOD WITH ARTICULATING BLOCKS 11/650,763, SERPENTINE BUOYANT CABLE ANTENNA SYSTEM 11/650,764, and BUOYANT CABLE ANTENNA SYSTEM 11/650,761, having the same filing date.

BACKGROUND OF THE INVENTION (1) Field of the Invention

The present invention relates generally to a buoyant cable antenna system and, in a more particular preferred embodiment, to a buoyant cable antenna system with extended frequency range capability.

(2) Description of the Prior Art

Present buoyant cable antenna systems which serve as a towed platform by underwater vehicles such as submarines consist of a horizontal wire antenna element used for reception in the LF through VHF frequency band (10 kHz-130 kHz). The horizontal antenna element lies on the surface of the ocean and reception is limited by transmission line attenuation, amplifier gain and antenna characteristics. Sea water attenuation, antenna gain and frequency patterns limit the use of a horizontal antenna element. The waves may frequently wash over the cable thereby interrupting transmissions. This is especially likely to happen when the platform is being towed through the water. Moreover, this type of towed platform is quite limited in the types of antennas that can be utilized therewith. Other towed platforms could be used, but are not capable of being deployed and retrieved into a submerged vessel.

The buoyant cable antenna must be flexible because a submerged submarine preferably launches the cable antenna through a transfer mechanism which bends the cable through a six-inch radius. Because flexibility is required, buoyant cable antennas have employed the horizontal wire antenna element which receives signals from the fore and aft (front and back) direction relative to its deployment. The limited antenna gain pattern limits the reception capability of the buoyant cable antenna.

Various inventors have addressed similar problems related to buoyant cable antennas as discussed in the following patents. Thus, the present invention addresses a long felt need for an improved buoyant cable antenna system.

U.S. Pat. No. 5,272,486, issued Dec. 21, 1993, to Stuart C. Dickinson, discloses an apparatus for erecting and stowing a communications antenna from an underwater buoyant cable. In its stowed position, the antenna is approximately parallel to the cable. In its erected position, the antenna is approximately perpendicular to the cable. A hinge, spring biased to maintain the antenna in its stowed position, is connected to the cable and to one end of the antenna. A shape memory alloy actuator is connected to the cable and the antenna. The actuator overcomes the spring bias of the hinge to raise the antenna to its erected position when energy of activation is supplied thereto. Further, the actuator allows the spring bias of the hinge to return the antenna to its stowed position when the energy of activation is removed there from.

U.S. Pat. No. 5,517,202, issued May 14, 1996, to Patel et al., discloses a buoyant antenna for providing sufficient transmission time windows for communication at ultra-high and extremely-high frequencies. The antenna is configured to float on the surface of a body of water and is connected to a vessel through a communications cable. The buoyant antenna has a length and a stabile or rotation resistant cross-section which minimizes wash over when deployed in a manner which essentially eliminates in line tension on the antenna. The antenna is cylindrically shaped with sensor elements offset from the centerline. A high density mass is placed diametrically opposite the sensor elements and a high buoyancy foam fills out the remaining cylindrical shape. The high density mass creates a righting moment to maintain the sensor elements above the water line. The absence of in line tension during communication periods serves also to eliminate any detectable wake during those communication periods. The lack of detectability makes the antenna and its deployment method particularly well suited for use when the vessel is a submarine.

U.S. Pat. No. 5,933,117, issued Aug. 3, 1999, to Erich Max Gerhard, discloses a buoyant loop antenna, deployable along a cable that includes a core region comprising a plurality of annular ferrite beads. These annular shaped beads include a center hole and generally concave first end and a generally convex second end. The ferrite beads are aligned with the concave end of one bead against the convex end of another bead. This allows the cable to flex while the beads maintain contact with each other, providing flexibility and resistance to crushing. The core region has a loop wire wrapped helically around it, forming the loop antenna. The loop wire element starts and ends at the same end of the core region, forming a loop. This loop allows transmission and reception in the athwart (side to side) direction. This novel wire loop antenna can be combined with a straight wire antenna (which provides reception in a fore and aft direction) to provide an omnidirectional cable antenna assembly.

U.S. Pat. No. 3,961,589, issued Jun. 8, 1976, to Anthony Joseph Lombardi, discloses a reeling system that is contained within a buoy towed by a submerged submarine. The reeling system includes a pressure sealed housing, a cable reel disposed for rotation within the housing and a buoyant cable antenna disposed in an ejecting and retracting relationship with the reel. One end of the cable antenna extends from the housing to the exterior of the buoy. A cylinder-piston arrangement having a sea water inlet and a connection to the housing is responsive to the pressure of the sea water at the inlet to control air pressure in the housing to provide a pressure difference between the air pressure in the housing and the pressure of the sea water on the one end of the cable antenna exterior of the buoy for ejection and retraction of the cable antenna from and into the buoy.

U.S. Statutory Invention Registration No. H1220, published Aug. 3, 1993, to Brian L. Pease, discloses a VLF-VHF broadband in-line amplifier that forms a portion of a towable buoyant cable antenna system that is deployed in seawater from submarines. The amplifier is located between an antenna system and a coaxial cable. The coaxial cable is connected to the submarine. The VLF-VHF broadband in-line amplifier provides substantially uniform amplification for the frequency range of 10 kHz-160 MHz on signals received from the antenna system. The amplified signals are then transmitted to the submarine over the coaxial cable.

The above patents do not describe a platform that can utilize a wide range of antennas, maintain the antenna far enough above the surface of the water to prevent washover communication breakdown, and, if desired, operate while a submarine is moving. The solutions to the above-described problems have been long sought without success. Consequently, those skilled in the art will appreciate the present invention that addresses the above and other problems.

SUMMARY OF THE INVENTION

It is a general purpose and object of the present invention to provide an extended frequency range capability to the Buoyant Cable Antenna System.

It is another object of the present invention to use a coil form to provide a suitable configuration for a platform that permits use of a wide range of different types of antennas.

It is yet another object of the present invention to provide an improved towed platform which substantially avoids the problems of waves washing over the platform which cut off communication signals.

It is yet another object of the present invention to provide an improved configuration that provides a stable antenna support in the water.

These and other objects, features, and advantages of the present invention will become apparent from the drawings, the descriptions given herein, and the appended claims. However, it will be understood that above listed objects and advantages of the invention are intended only as an aid in understanding aspects of the invention, are not intended to limit the invention in any way, and do not form a comprehensive list of objects, features, and advantages.

Accordingly, the present invention provides a buoyant, flexible antenna system operable for use in water. The system may comprise one or more buoyant sections of a transmission line for supporting at least a portion of the transmission line along a surface of the water. A flexible linear keel section of the transmission line may comprise weight elements such that the linear keel section has a density greater than water and sinks in water. The weight elements may be selected and positioned such that the flexible linear keel section sinks to a selected depth or range of depths below a surface of the water. In one embodiment, a rotary connection couples and/or physically connects the buoyant portion of the transmission line to the flexible linear keel portion. A buoyant platform portion of the transmission line on an opposite side of the flexible keel portion from the rotary connection extends upwardly from the flexible keel portion. One or more antennas may be mounted to the buoyant platform portion of the transmission line and extend above a surface of the water.

The buoyant sections of the transmission have sufficient length to provide sufficient buoyant force to prevent the flexible linear keel section of the transmission line from sinking to a greater depth than a selected maximum depth.

In one possible embodiment, one or more curved outrigger portions of the transmission line float on a surface of the water and extend from an approximate center line of the buoyant transmission line in a direction transverse with respect to the flexible linear keel section. The curved outrigger portions may further comprise a first curved section and a second curved section such that the first curved section and the second curved section extend outwardly from the centerline of the cable in opposite directions.

In one embodiment, the system may further comprise a first flexible weighted keel section of the transmission line and a second flexible weighted keel section of the transmission line. The buoyant platform portion may be positioned there between.

A method is provided for the buoyant cable system which may comprise steps such as, for instance, providing a transmission line that may be spooled out from a submerged vessel, providing that one or more buoyant portions of the transmission line are sufficiently buoyant to cause the transmission line to float to a surface of the water, weighting at least one portion of the transmission line to form at least one weighted keel portion of the transmission line, providing that the one or more buoyant portions of the transmission line and the weighting of the weighted keel portion substantially determines a maximum water depth of the weighted keel portion, and/or providing a buoyant platform section of the transmission line on an opposite side of the weighted keel portion with respect to the one or more buoyant portions of the transmission line, and/or providing one or more antennas on the buoyant platform section of the transmission line for extending above the surface of the water.

The method may comprise, if desired, providing a first weighted keel portion and a second weighted keel portion spaced apart with respect to each other, and providing the buoyant platform portion there between. The method may further comprise providing that the buoyant platform portion is substantially in the shape of an inverted U configuration wherein at least a portion of the inverted U extends above the surface of the water and/or supporting at least one antenna in a substantially horizontal position with respect to the water surface utilizing the inverted U configuration buoyant platform.

The method may further comprise positioning a rotary connector between the weighted keel portion and the buoyant portions of the transmission line. In one preferred embodiment, the method may also comprise providing two opposing buoyant outrigger curve portions of the transmission line roughly adjacent or near the weighted keel portion to provide additional stability of the one or more antennas.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawing, wherein like reference numerals refer to like parts and wherein.

DESCRIPTION OF THE PREFERRED EMBODIMENT

The present invention provides a towed platform for an antenna that would be towed at the end or roughly near the end of the buoyant cable transmission. The weighted keel discussed in more detail below would provide vertical/horizontal stability for antennas of many types (i.e. monopole, dipole, helical, spiral, patch). When the assembly is deployed by a submerged vessel, the buoyant antenna assembly employs the use of one or more weighted keels to assure proper position on the sea water surface and a rotary joint to nullify the towing effects of the transmission line. Increased frequency band reception, antenna frequency gain and pattern enhancement are advantages and new features. Flexible shape permits passage through deployment mechanisms.

Figure 1:
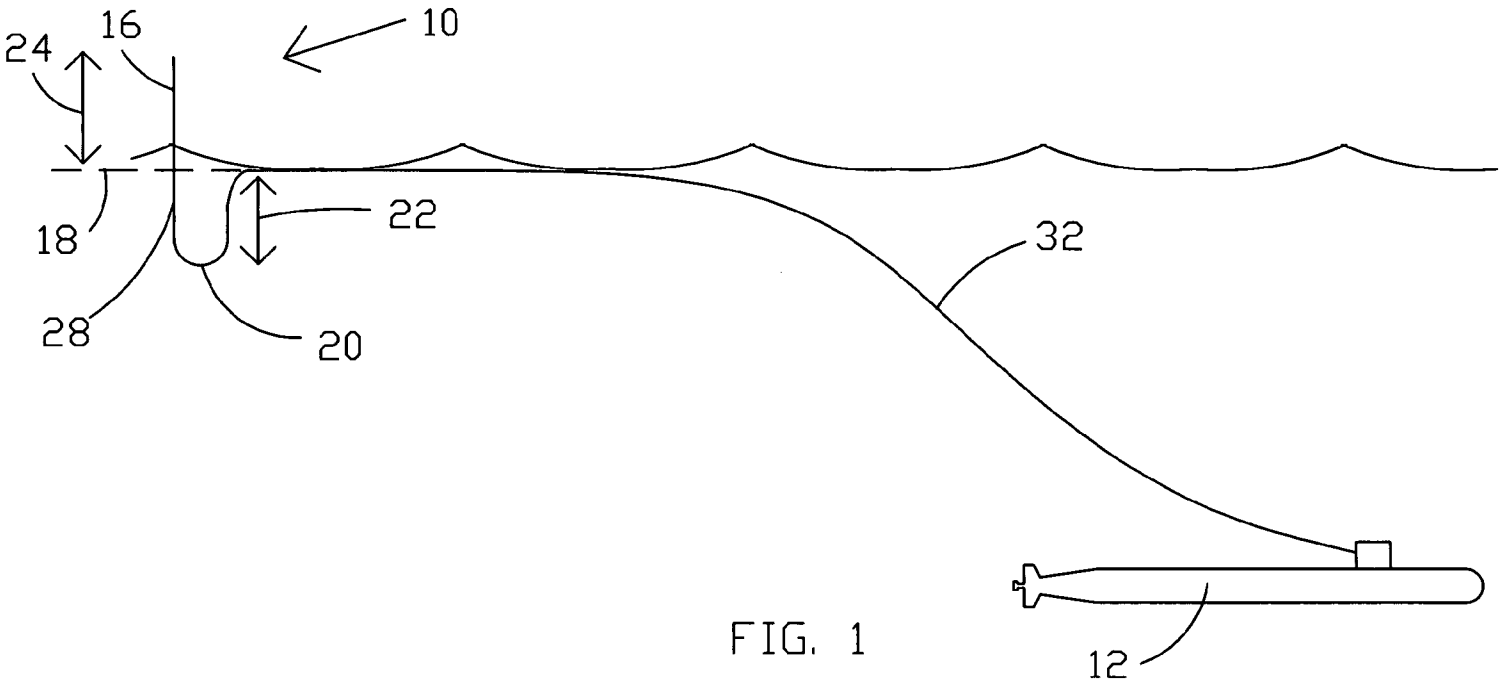
FIG. 1 is a schematic diagram of one embodiment of a buoyant cable antenna system to provide a vertically or horizontally mountable antenna extendable from the water surface in accord with one possible configuration of the present invention.

Referring now to the drawings, and more particularly to FIG. 1, there is shown one possible embodiment of a towed buoyant platform system 10 for use with submerged submarine 12 in accord with the present invention. Other shapes and constructions may also be used that avoid the problems of prior art horizontal wire antennas that are subject to waves that block data flow. However, the present invention can also be utilized in conjunction with a horizontal wire antenna which is mountable above the water surface to avoid waves, e.g., FIG. 3.

In FIG. 1, towed platform 10 provides what may be referred to as a buoy construction whereby a portion of the transmission line and/or the antenna, such as portion 16 may actually, if desired, protrude above water line. The water surface provides a plane which is typically roughly coincident with centerline 18 of buoyant transmission line 32.

Towed platform 10 provides a weighted, yet flexible, keel portion 20 that may be curved to place keel portion 20 below the water surface. Due to buoyant force, portion 16 extends upwardly above the water surface, if desired. For this purpose, this embodiment of keel portion 20 may have a substantially U-shaped configuration or at least may be formed in a curved shape. Keel portion 20 sinks below the plane of the water surface and the approximate theoretical centerline of buoyant transmission line 32. Weights such as weights 26 (shown in FIG. 3) may be selected and positioned to maintain keel portion 20 at desired depth or depth range 22 beneath the water surface. Depth 22 then provides a suitable length of underwater cable to produce sufficient buoyant force for buoyant platform portion 28 to support antenna portion 16 at a desired height 24 above the water surface, if desired. In one preferred embodiment, the buoyant force produced by the remainder of the buoyant transmission line cable 32 acts to prevent keel portion from sinking below depth 22 by providing most of the upward force on keel portion 20. Thus, the buoyant force produced by antenna support portion 16 is mostly utilized for supporting one or more antennas mounted on the end of portion 16. The depth 22 may also be influenced by a predetermined shape of keel portion 20. The predetermined shape for an otherwise flexible cable can be controlled as discussed in detail in my other U.S. patent applications referenced hereinbefore.

Various types of weights may be utilized in keel portion 20. However, when used as part of a spoolable cable it is desirable that the weights, such as weights 26, provide flexibility so buoyant cable 32 may be spooled from a drum for extension and withdrawal from submarine 12. To form a flexible weight section, linked weight elements, and/or multiple weight elements such as separate weight sections 26, and/or other flexible weight mountings, may preferably be utilized and may preferably be comprised of a high density material such as lead, titanium, or the like. In the embodiment of FIG. 1, keel portion 20 is weighted in a manner that provides for vertical stability to antenna support section 16 to thereby support antenna section 16 at desired height or range of heights 24 above the surface of the water. Depending on the type of antenna, selected height or range of heights 24 may affect transmission range, frequency, and the like.

A rotary joint, such as rotary joint 30 (FIG. 3), may be used to permit rotation of keel portion 20 with respect to transmission line 32 while still maintaining an electrical connection therewith to thereby permit upright positioning and avoid the towing effects that might rotate or twist transmission line 32.

The antenna on the end of antenna section 16 could be comprised of many different types of antenna constructions. Some antennas suitable for placement at section 16 might include monopole antennas, dipole antennas, helical antennas, spiral antennas, patch antennas, and the like. Such antennas are well known to have a wide range of frequency capabilities and can be designed for many frequency gain patterns. Thus, the present invention may be used to thereby utilize a wide range of different types of antennas only a few of which have been mentioned. The antenna may be mounted only at section 16 or may be mounted anywhere along towed platform 10 and may be used in conjunction with a horizontal wire type antenna mounted to transmission line 32. Moreover, multiple antennas may be mounted to towed platform 10, at the same or at various positions, if desired.

Figure 2:
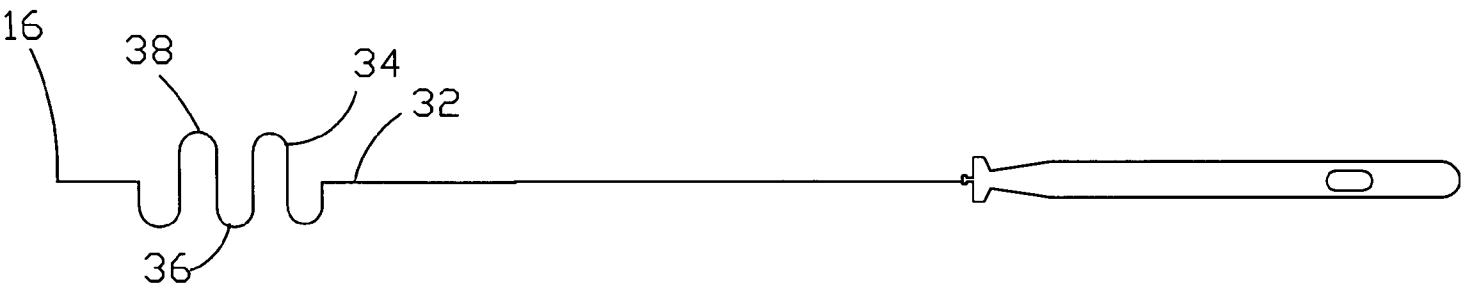
FIG. 2 is a schematic diagram of a top view of an embodiment of a cable antenna with buoyant outrigger support cable portions extending outwardly on the surface of the water in accord with another possible configuration of the present invention.

Referring to FIG. 2, outrigger buoyant cable portions 34, 36, and 38, may be utilized in conjunction with keel portion 20 to maintain antenna portion 16 pointed vertically upwardly. Thus, outrigger buoyant cable portions 34, 36, and 38 extend preferably transversely, orthogonally, or at substantially right angles with respect to keel portion 20 which drops vertically downwardly due to the weight thereof. The buoyant force from the water supports cable portions 34, 36, and 38 in this transverse position. Means and methods for forming cable portions 34, 36, and 38 such that the transmission line remains sufficiently flexible are discussed in some detail in my above referenced U.S. patent applications. If desired, laterally extended cable portions 34, 36, and 38 may also be used alone to provide a towed platform support for antennas such as vertical antennas. Laterally extended curved cable portions 34, 36, and 38, are buoyant to thereby float near or on water surface 29. In the example of FIG. 2, laterally extended curved cable portion 36 thereby counterbalances one or more other laterally extended curved cable portions such as curved portions 34 and 38 so as to further support vertical antenna section 16, if used, in a vertical position during towing.

Figure 3:
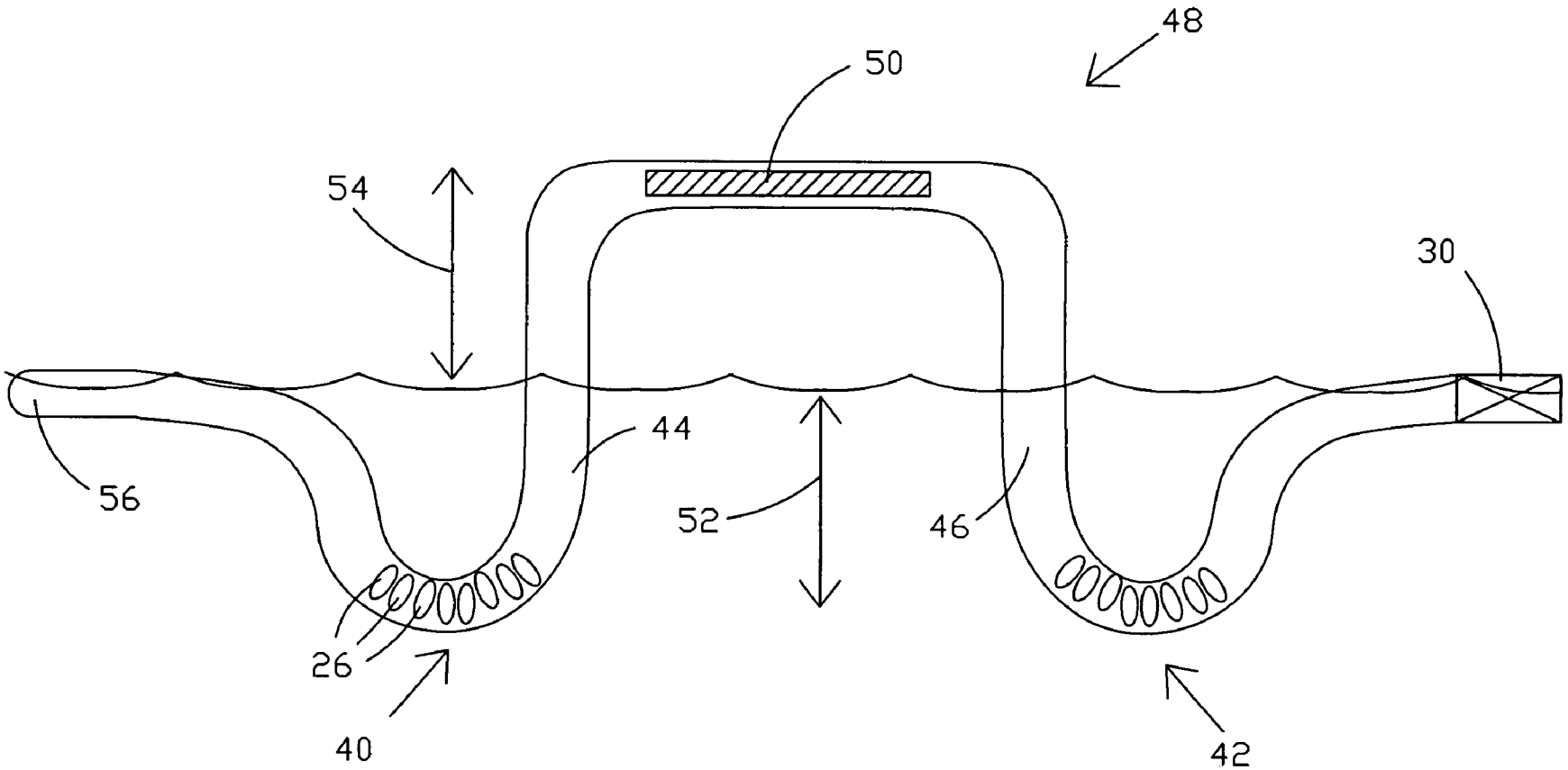
FIG. 3 is an elevational view, partially in cross-section, of a buoyant cable antenna comprising multiple weighted sections in accord with yet another possible configuration of the present invention.

FIG. 3 discloses one embodiment of the present invention that comprises multiple weighted keel portions 40 and 42. In this embodiment of the invention, the two keel portions provide the possibility of two buoyant supports 44 and 46 for supporting a platform 48 that may extend above the surface of the water. In this way, additional stability may be provided due to the use of two buoyant supports 44 and 46. Outermost end 56 of the buoyant transmission line should be sufficiently long to provide most of the necessary buoyant force to support the final weighted keel portion from sinking, such as keel portion 40. In this embodiment, a horizontal antenna 50 is provided that may be designed to extend from the water surface above any waves to avoid communication interruptions caused by waves. Moreover, other types of antennas could be utilized there. By selecting the position of the weights and the distance 52 below the surface, the amount of available buoyant force produced by supports 44 and 46 can be controlled and height 54 of inverted U configuration antenna platform 48 can be designed accordingly. Therefore, the configuration of the present invention provides wide flexibility in the type of antenna platforms that can be utilized. Moreover, additional weighted keel portions may be utilized to support a plurality of different types of antennas so as to provide the capability for simultaneously sending/receiving a wide range of signals and/or large amounts of data within a short time period. If desired, antennas may be hingeably mounted to support 48 and may have a counterweight at an opposite end to thereby extend or move to a vertical position once they are raised above the water surface.

In summary, a flexible cable configuration is provided to form a stable platform which may be used to support various types of antennas as desired. One or more embodiments of the above may be utilized to maintain an antenna above the water surface while a submarine is moving. However, additional action by the submarine in changing directions or altering the rate of spooling of cable may be utilized to let the antenna become still if, due to very rough seas or the like, such action becomes necessary. Moreover, the antennas may comprise additional moving elements, telescoping sections controlled by floats, and the like, to provide that the antenna is in a desired position and a desired height above the surface of the water. Motors, controllable valves acting with water flow, actuators, and the like may be utilized to raise or lower or position antennas as desired from the floating transmission line.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A buoyant, flexible antenna system operable for use in water with a transmission line, said system comprising:

at least one buoyant section of said transmission line for supporting at least one portion of said transmission line along a surface of said water;

a flexible weighted keel section of said transmission line, said flexible weighted keel section comprising weight elements such that said flexible weighted keel section has a density greater than water and sinks in water, said weight elements being selected and positioned such that said flexible weighted keel section sinks no lower than a selected maximum depth range below a surface of said water during operation;

a rotary connection for coupling between said buoyant portion of said transmission line and said flexible weighted keel portion;

a buoyant platform portion of said transmission line on an opposite side of said flexible weighted keel portion from said rotary connection, said buoyant platform portion extending upwardly from said flexible weighted keel portion; and at least one antenna mounted to said buoyant platform portion of said transmission line.

2. The system of claim 1, wherein said at least one antenna extends above said surface of said water.

3. The system of claim 1, wherein said at least one buoyant section of said transmission line has a sufficient length to provide a buoyant force to prevent said flexible linear keel section of said transmission line from sinking to a greater depth than said selected maximum depth.

4. The system of claim 3, further comprising at least one curved outrigger portion of said transmission line for floating on said surface of said water, said at least one curved outrigger portion of said transmission line extending from a centerline of said transmission line in a direction transverse with respect to said flexible linear keel section.

5. The system of claim 1, wherein said at least one section further comprises a first curved section and a second curved section such that said first curved section and said second curved section extend outwardly from said centerline of said cable in opposite directions.

6. The system of claim 1, further comprising a first flexible weighted keel section of said transmission line, and a second weighted linear keel section of said transmission line, said buoyant platform portion being positioned there between.

7. A method for a buoyant cable system for use in water, said method comprising the steps of:

providing a transmission line that may be spooled out from a submerged vessel;

providing that at least one buoyant portion of said transmission line is sufficiently buoyant to cause said transmission line to float to a surface of said water;

weighting at least one portion of said transmission line to form at least one weighted keel portion of said transmission line;

providing that said at least one buoyant portion of said transmission line and said weighting substantially determines a maximum water depth of said at least one weighted keel portion;

providing a buoyant platform section of said transmission line on an opposite side of said weighted keel portion with respect to said at least one buoyant portion of said transmission line; and providing at least one antenna on said buoyant platform section of said transmission line for extending above said surface of said water.

8. The method of claim 7, further comprising providing a first weighted keel portion and a second weighted keel portion spaced apart with respect to each other, and providing said buoyant platform portion there between.

9. The method of claim 8, further comprising providing that said buoyant platform portion is substantially in an inverted U configuration.

10. The method of claim 9, wherein at least a portion of said inverted U configuration extends above the surface of said water.

11. The method of claim 10, further comprising mounting at least one antenna in a substantially horizontal position with respect to said water surface with said inverted U configuration.

12. The method of claim 7, further comprising positioning a rotary connector between said at least one weighted keel portion and said at least one buoyant portion of said transmission line.

13. The method of claim 7, further comprising providing two opposing buoyant outrigger curve portions of said transmission line adjacent to said weighted keel portion to provide additional stability to said at least one antenna.

* * * * *